United States Patent [19]

Wallot

[11] 4,327,309

[45] Apr. 27, 1982

[54] FLUORESCENT LAMP POWER SUPPLY WITH LOW VOLTAGE LAMP POLARITY REVERSAL

[75] Inventor: George P. Wallot, Fort Wayne, Ind.

[73] Assignee: General Electric Company, Salem, Va.

[21] Appl. No.: 162,276

[22] Filed: Jun. 23, 1980

[51] Int. Cl.[3] ..... H05B 41/14

[52] U.S. Cl. ..... 315/170; 315/171; 315/176; 315/289; 315/311; 315/362; 315/DIG. 5; 361/246

[58] Field of Search ..... 315/170, 172, 175, 289, 315/307, 311, DIG. 2, DIG. 5, 362, DIG. 7, 171, 176; 307/138; 361/245, 246

[56] References Cited

U.S. PATENT DOCUMENTS

| | | | |
|---|---|---|---|
| 3,767,970 | 10/1973 | Collins | 315/311 X |
| 3,801,867 | 4/1974 | West et al. | 315/311 X |
| 3,833,761 | 9/1974 | Houck | 315/DIG. 5 |
| 3,890,562 | 6/1975 | West | 315/311 X |
| 3,953,763 | 4/1976 | Herrick | 315/DIG. 7 |
| 4,260,932 | 4/1981 | Johnson | 315/DIG. 5 |

*Primary Examiner*—Eugene R. LaRoche

*Attorney, Agent, or Firm*—James H. Beusse; Arnold E. Renner

[57] ABSTRACT

A solid-state ballast circuit for starting and regulating a gaseous discharge lamp which is operated on direct current is arranged so as to permit the use of low voltage switching relays to effect polarity reversal of the lamp under load. A high voltage pulse source is connected in series with the lamp and a low voltage switching relay is connected in a manner to effect polarity reversal of the DC voltage applied to the combination of the high voltage source and lamp. The voltage appearing across the high voltage source is prevented from reaching the switching relays by virtue of a bridge rectifier circuit connected such that the pulse source and lamp appear as a current source for the rectifiers. The output terminals of the bridge rectifier arrangement are connected between the output terminals of the low voltage DC source thus limiting the voltage applied to the switching relays to a value not exceeding that of the DC source. The circuit also includes apparatus for monitoring the levels of lamp current and for disabling the lamp circuit if the monitored current exceeds a predetermined magnitude.

12 Claims, 4 Drawing Figures

LAMP
34
40
36
164
166
101
182
110
112
122
184
T2 SEC
100
118
11
186
124
188
116
120
114
194
220
222
190
270
+V_B
262
258
T2
PRI
96
276
256
268
192
224
272
260
266
264
274
300
236
298
292
294
302
240
296
320
326
328
322
324
238
250

FLUORESCENT LAMP POWER SUPPLY WITH LOW VOLTAGE LAMP POLARITY REVERSAL

BACKGROUND OF THE INVENTION

This invention relates to an improved electronic ballast circuit used for gaseous discharge lamps operating on direct current (DC) voltage. More particularly, it relates to apparatus for permitting reversal of the DC voltage applied to a lamp without impressing excessive voltage stresses on switching components.

Gaseous discharge lamps, such as, for example, fluorescent lamps, are basically designed to operate from alternating current (AC). However, when operated with AC current, the lamp exhibits a phenomenon known as AC flicker effect. In essence, the lamp illumination varies as the applied AC current switches from a positive to a negative half-cycle. Although this flicker effect is not apparent to the human eye, it is often sensed by the faster responding photo-recepters used in photocopiers. As machines tend toward faster speed, flicker effect results in more distortion of the copy fidelity.

In order to avoid the flicker effect, most photocopiers utilize a highly regulated DC current for the fluorescent lamp in order to reduce all components of light intensity versus time to a negligible level. However, when a fluorescent lamp is operated at a constant DC current, the fluorescent lamp goes through a process of mercury migration. This phenomenon, i.e., mercury migration, results in a nonuniform brightness of the lamp from one end to the other. The mercury migration process generally starts slowly but eventually ends in a quite noticeable difference in lamp intensity across the fluorescent lamp. Such a variation in intensity across the lamp produces a photocopy which varies from dark to light across its face.

An additional problem encountered with the operation of fluorescent lamps is an effect known as anode darkening. Anode darkening is caused by an overheating of the anode of the lamp due to constant excessive bombardment of electrons. Overheating causes damage to the phosphors at the anode end of the lamp and results in no light being emitted near the anode end after a few hours of operation on DC current. As with the previous intensity problem with fluorescent lamps, this latter problem also produces nonuniform reproduction in the photocopying process.

The undesirable effects of mercury migration and anode overheating can be greatly reduced if the lamp current polarity is periodically reversed and if the illumination time is limited to the minimum time actually required to perform the photocopying function. Polarity reversal thus will result in a much more uniform brightness with better optical quality and greatly increased useful lamp life.

As is well known, a fluorescent lamp requires a high voltage initial application in order to ionize the gases within the lamp and start the current conduction through the gas. Once ionization has occurred, i.e., the lamp is lit, current can be maintained by a relatively low voltage. A lamp may require, for example, a starting voltage in the order of magnitude of 1,000 volts, whereas the maintaining voltage may be only in the order of magnitude of 80 volts. The high voltage start pulse may be applied by paralleling it with the lamp or by applying the pulse in series with the lamp. In either method, the high voltage appears across the lamp and provides the voltage necessary for the lamp to begin conduction. In those prior art systems which provide for polarity reversal across the lamp, there are also provided high voltage relays arranged about the lamp to provide for its effective reversal with respect to the DC voltage applied to maintain current conduction through the lamp. In all of these prior art systems, the high voltage start pulse, in addition to being applied across the lamp was also applied across the high voltage relays. The use of high voltage relays was necessary to prevent relay contact arcing rather than starting the fluorescent lamp. The use of high voltage relays in such circuits is generally undesirable because of their relatively high cost and tendency to weld contacts when operated on DC.

SUMMARY OF THE INVENTION

Accordingly, it is a general object of the present invention to provide an improved electronic starting and ballasting circuit for a gaseous discharge lamp operating from direct current.

It is a more specific object of this invention to provide an electronic solid-state starting and ballasting circuit which avoids the need for high voltage relays.

It is a still further object of this invention to provide an electronic ballast circuit which permits lamp current reversal while the lamp is illuminated.

It is another object of this invention to provide an electronic ballast circuit which permits extinguishing the lamp without impressing high voltages on the current reversing switching devices or circuit components.

In accordance with one form of the present invention, there is provided a DC power source for operating a gaseous discharge lamp. A high voltage pulse source for starting the lamp is connected in series circuit arrangement with the lamp. Contacts of current reversing relays are connected at each end of the series combination of the lamp and the high voltage pulse source. The switching relays are arranged in conjunction with a low voltage power supply to reverse the polarity of the voltage applied by the low voltage power supply across the series combination of lamp and high voltage source. This arrangement thus assures that the high voltage starting pulse will of necessity force a current through the lamp without arcing any of the switching elements. In addition, in order to permit switching of the lamp while illuminated, there is provided a full-wave diode bridge connected about the series combination of the lamp and high voltage source such that the lamp high voltage source appear as a power source for the full-wave diode bridge. The two output terminals of the diode bridge are connected across the output terminals of the low voltage DC source. In this arrangement, the switching action thus switches only the low voltage DC source and the switching relays are isolated from the high voltage power supply and any inductive current generated voltages.

BRIEF DESCRIPTION OF THE DRAWING

The subject matter which is regarded as the invention is set forth in the appended claims. The invention itself, however, together with further objects and advantages thereof may be better understood by reference to the following description taken in conjunction with the accompanying drawings in which:

DESCRIPTION OF THE PREFERRED EMBODIMENT

Figure 1:
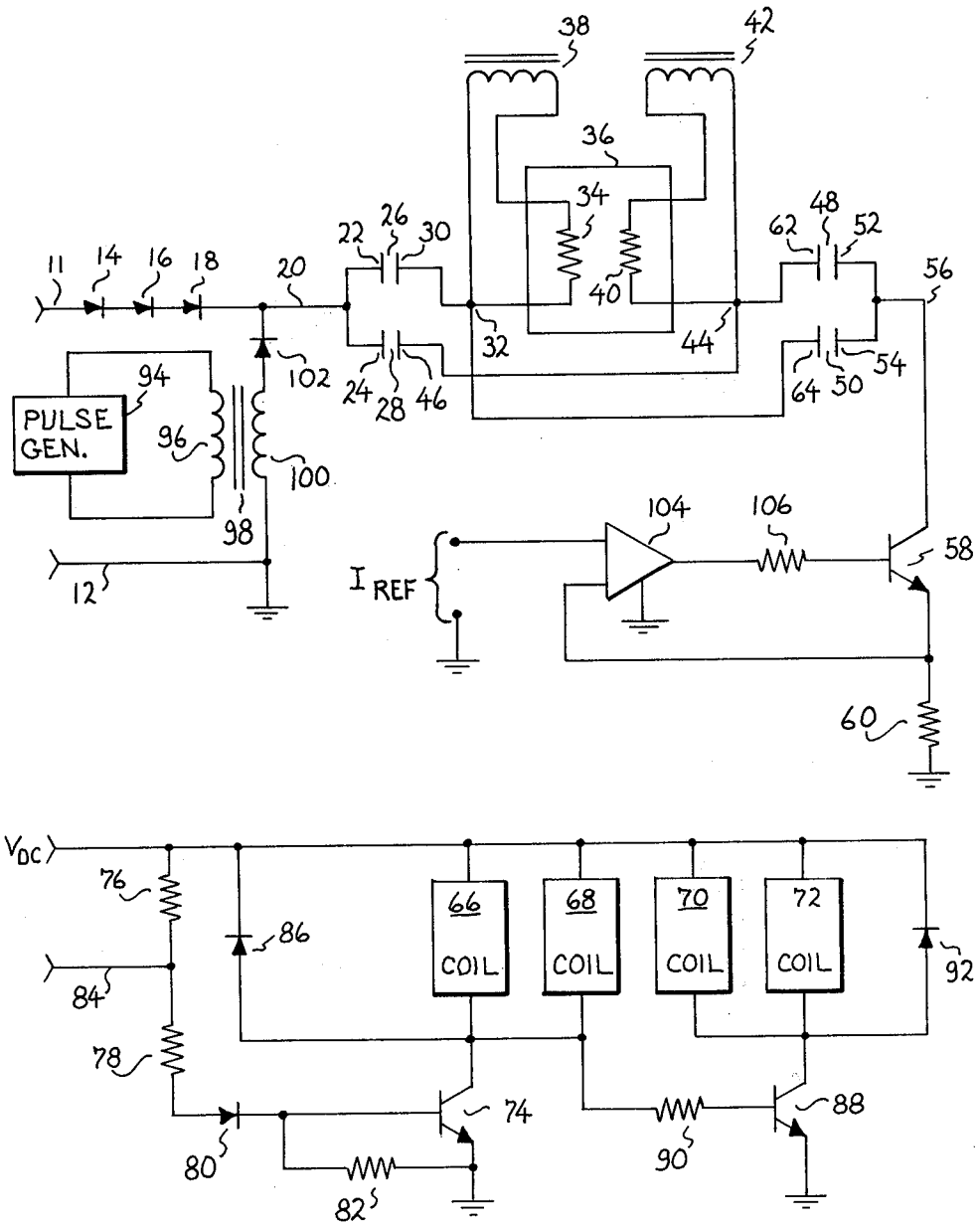
PRIOR ART FIG. 1
FIG. 1 is a simplified circuit diagram of one form of a prior art electronic ballasting circuit.

Referring to FIG. 1, the typical prior art solidstate starting and ballast circuit for a DC operated gaseous discharge or fluorescent lamp comprises a source (not shown) of relatively low voltage direct current such as, for example, 80 volts applied to line 11 with respect to a ground or common return line indicated at 12. The low voltage DC current supplied on line 11 is coupled through the blocking diodes 14, 16 and 18 to a line 20 which is connected to terminals 22 and 24 of a pair of relay contacts 26 and 28, respectively. A terminal 30 of contacts 26 is connected to a terminal 32 at one end of a heated electrode 34 within a gaseous discharge fluorescent lamp 36. A source of low voltage AC power, such as is indicated by the secondary winding 38 of a power transformer (not shown), provides sufficient power to maintain the proper temperature of the electrode 34. The lamp 36 includes a second electrode 40 at its opposite end from electrode 34 which is also heated by a secondary winding 42 which may be a winding of the same power transformer as the winding 38. A terminal 44 of the electrode 40 is connected to a contact terminal 46 of the relay contacts 28. A second pair of relay contacts 48 and 50 each include a terminal 52 and 54, respectively, which are connected together to a line 56. The line 56 provides a ground return for the current through the lamp 36 via a current regulating transistor 58 and a current measuring resistor 60. The contacts 48 include a second terminal 62 which is connected to the terminal 44 at the electrode 40 of the lamp 36. A second terminal 64 of the contacts 50 is connected to the terminal 32 of electrode 34.

As can be appreciated, if the contacts 26 are closed and the contacts 48 are closed and contacts 28 and 30 are open, there is provided a conventional current path through the fluorescent lamp 36 from the line 11 through the contacts 26, the electrode 34 to the electrode 40 and then through the contacts 48, the current regulating transistor 58 and current measuring resistor 60 to the return line 12. Conversely, if the contacts 28 and contacts 50 are closed, with the contacts 26 and 48 being open, there is provided a conventional current path from the line 11 through the contacts 28 to the electrode 40, thence through the lamp 36 to the electrode 34, to terminal 32 and from there through the contacts 50 to the current regulating transistor 58 and current measuring resistor 60 returning to line 12.

The contacts 26, 28, 48 and 50 may be controlled by simple logic circuit such as that illustrated in FIG. 1 for controlling the contactor coils 66, 68, 70 and 72. Typically the contactor coils are low voltage relay coils which may be supplied from a low voltage source such as that indicated at $V_{DC}$. The coils 66 and 68 each have a terminal connected to a collector terminal of a transistor 74 with the opposite terminals of the coils 66 and 68 being connected to the positive voltage source $V_{DC}$. The emitter terminal of the transistor 74 is connected to a ground return line so that the transistor 74 operates as a switch to permit current to flow through the coils 66 and 68 whereby they may be operated to control the contacts 26 and 48. The transistor 74 is maintained in a normally conducting condition by virtue of current supplied from the source $V_{DC}$ through a resistor 76, a resistor 78 and a diode 80. A stabilizing resistor 82 is connected between the base terminal of transistor 74 and its emitter terminal. A control signal input line 84 is connected to the junction intermediate the resistors 76 and 78. When the signal on the input line 84 is a zero volts or ground signal, no current will be supplied to the base terminal of the transistor 74 and the transistor will be turned off. With the transistor 74 turned off, insufficient current will be drawn through the relay coils 66 and 68 to maintain them in an energized condition and the contacts 26 and 48 will open. The diode 86 provides a discharge path for the inductive current stored in relay coils 66 and 68 when transistor 74 is turned off.

The relay coils 70 and 72 each have one terminal connected to the positive voltage source $V_{DC}$ and the opposing terminals of each are connected to the collector function of a transistor 88. The emitter terminal of the transistor 88 is connected to the ground or the return line. The base terminal of the transistor 88 is connected through a base current limiting resistor 90 to the collector terminal of the transistor 74. As will be apparent, when the transistor 74 is conducting, no base drive current will be supplied to the transistor 88 and it will be maintained in a nonconducting state. However, when transistor 74 is turned off so that it becomes nonconducting, a small amount of current will flow through the coils 66 and 68 and the resistor 90 and provide sufficient base drive to the transistor 88 to force it into a conducting state. In a conducting state, the current through transistor 88 will cause the relay coils 70 and 72 to be energized thereby closing the contacts 28 and 50. Under this condition, the voltage as described above across the lamp 36 will be reversed. When the transistor 88 is turned off by the initiation of conduction of transistor 74, energy stored in the coils 70 and 72 will be dissipated through the diode 92 connected in parallel with those coils.

The high voltage start pulse for the lamp 36 is supplied from a pulse generator 94 of a type well known in the art. The output of the pulse generator is coupled through a primary winding 96 of a pulse transformer 98. The pulse transformer 98 has a secondary winding 100 across which the output pulse is generated. The secondary winding 100 has one terminal connected to the referenced line 12 and a second terminal connected through a blocking diode 102 to the positive voltage line 20. The blocking diode 102 prevents the relatively low DC impedance of the secondary winding 100 from shorting out the voltage developed between the lines 20 and 12. As will be appreciated, the high voltage pulse developed across the secondary winding 100 between lines 12 and 20 is also impressed across the series combination of relay contacts 26 and 28, lamp 36, relay contacts 48 and 50, the collector-emitter junction of current regulator transistor 58 and current measuring resistor 60. Obviously at the time of applying the start pulse one set of contacts at each end of the lamp 36 are necessarily closed in order to provide a current path for lamp current. Once the lamp 36 has been energized, the low voltage power supply voltage applied on line 11 maintains conduction and illumination of the lamp. Control of the current through the lamp when illuminated or "lit" is affected by operation of the transistor 58. Transistor 58 is controlled by a comparison amplifier 104 which compares the voltage developed across the current measuring resistor 60 against a reference voltage which may be supplied from a source well known in the art. The output voltage or error signal developed by the comparison amplifier 104 is coupled to the base terminal of the transistor 58 through a base resistor 106.

In the operation of the circuit of FIG. 1, when the pulse generator 94 is triggered, a high voltage pulse is impressed across the combination of the relay contacts and the lamp 36. Assuming, for example, that the contacts 26 and the contacts 48 are closed with the contacts 28 and 50 being open, a current path is formed from the line 20 through the contacts 26, the electrode 34, the lamp 36, the electrode 40 and then through the contacts 62, returning through the current regulating transistor 58 to ground. Unless the contacts 26, 28, 48 and 50 are actually high voltage contacts, the high voltage developed by the pulse transformer 98 may result in arching of the contacts 28 or 50 rather than ionization of the gases in the lamp 36. In practice, the contacts and associated coils are high voltage reed relays in which one actuating coil controls two pair of contacts.

Figure 2:
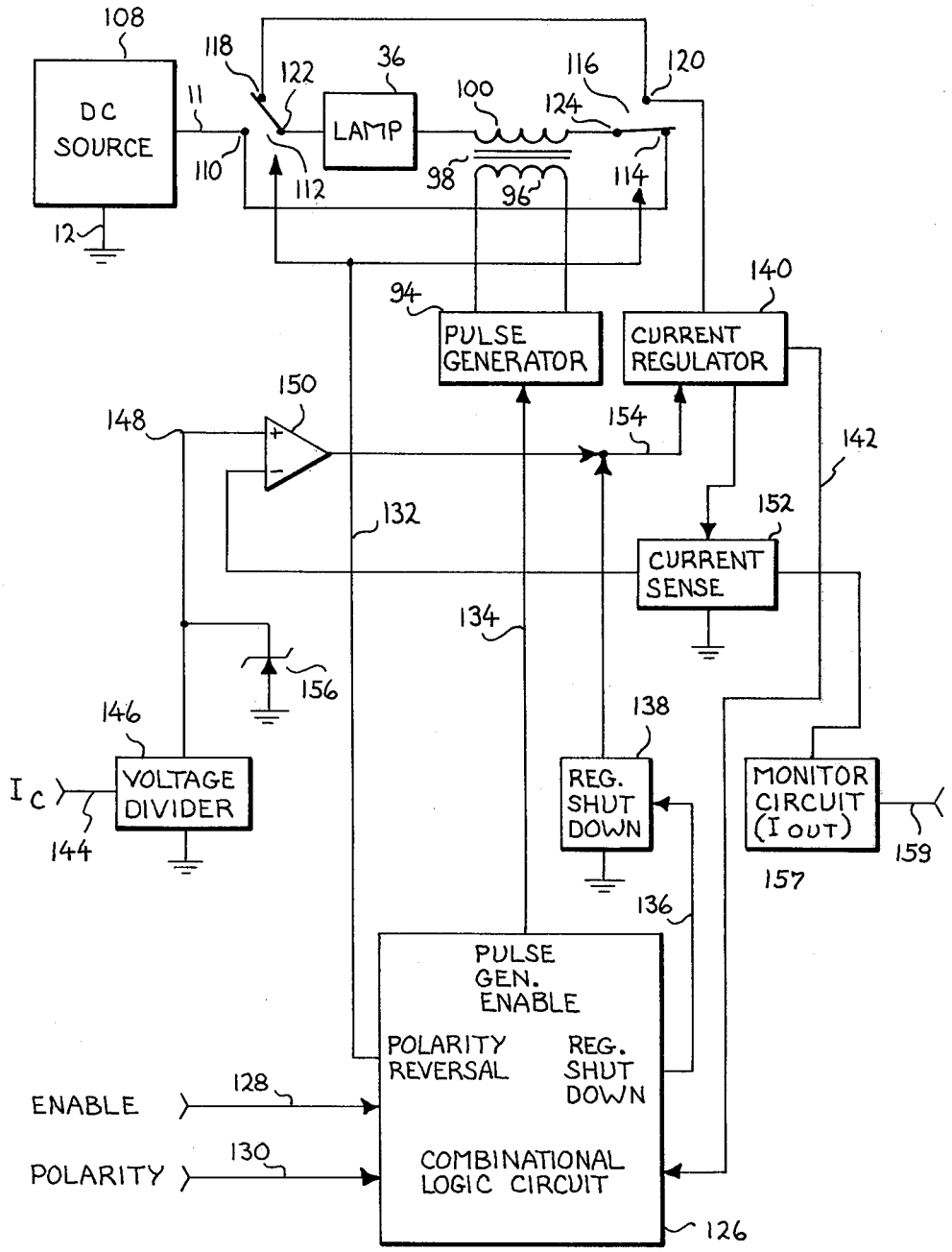
FIG. 2 is a simplified functional block diagram of an embodiment of the present invention; and, FIG. 3 comprising the two FIGS. labeled 3A and 3B is a detailed schematic diagram of a preferred embodiment of the present invention.

Referring now to FIG. 2, there is shown a simplified block diagram of one form of the present invention which obviates the need for high voltage relays in a system in which voltage reversal across the lamp 36 is desired. A DC source 108 is indicated as supplying the low voltage DC on lines 11 and 12. The line 11 is connected to a terminal 110 of a low voltage relay 112 and also to terminal 114 of a second low voltage relay 116. The line 12 is connected to a ground return or appropriate reference plane. The relay 112 is illustrated as having a movable contact arm which can swing between the terminal 110 and a terminal 118 to thereby connect either of these terminals to a third terminal 122 which is in turn connected to a first terminal of the lamp 36. A second terminal of lamp 36 is connected to one terminal of the secondary winding 100 of the pulse transformer 98. The opposite terminal of the winding 100 is connected to a contact terminal 124 of the relay 116. The relay 116 is essentially identical to the relay 112 and contains a movable contact arm attached to the terminal 124 which arm can swing between the terminal 114 and a terminal 120. Although illustrated as switches having movable contact arms, the relays 112 and 116 may be of a type well known in the art, such as, for example, a double pole, double throw relay which is wired to effect the result indicated in the schematic diagram. As will be appreciated, the secondary winding 100 of the pulse transformer 98 is now connected in a series current path with the lamp 36 in such a manner that any high voltage generated by the secondary winding 100 is of necessity impressed across the lamp through the pair of closed contacts of the relays 112 and 116 such that the open circuited contacts are not exposed to a voltage higher than that voltage supplied by the DC source 108.

In the illustrated environment a combinational logic circuit 126 responds to a lamp ENABLE command on line 128 and a POLARITY command on line 130 to start and maintain energization of the lamp 36. The logic circuit 126 provides a polarity reversal signal on line 132 to the actuating coils (not shown) of relays 112 and 116 which operates to reverse the position of the relays 112 and 116 to thereby reverse the polarity of the DC voltage applied to the lamp 36. The logic circuit 126 also supplies a signal on line 134 to the pulse generator 94 which causes the generator 94 to produce a high voltage pulse to effect starting of the lamp 36. When the lamp ENABLE signal on line 128 is removed, the logic circuit 126 also supplies a signal on line 136 to a regulator shutdown circuit 138 which turns off the current regulator 140 to effect turnoff of the lamp 36. The feedback signal from current regulator 140 is applied via line 142 to thelogic circuit 126 to indicate that the lamp 36 is off when it should be on.

Lamp intensity is controlled by the magnitude of current through the lamp 36 which, in turn, is controlled by the current regulator 140. Lamp intensity is set by a current command signal $I_C$ applied to a line 144 which is connected to an input terminal of a voltage divider circuit 146. The output signal developed by the voltage divider 146 is coupled via a line 148 to a first input terminal of an error amplifier 150. A second input terminal of the error amplifier 150 is connected to an output terminal of a current sensing device 152. The current sensing device 152 is connected in series with the current regulator 140 and provides an output signal representative of the magnitude of current flowing through the lamp 36. An output terminal of the error amplifier 150 is connected by a line 154 to a control input terminal of the current regulator 140. As can be seen, the error amplifier output terminal and the regulator shutdown 138 output terminal are coupled to the same input terminal of the regulator 140. When the regulator shutdown 138 commands a turn-off of the lamp 36, the voltage on line 154 is pulled down to a level to effect turn-off of the current regulator 140. Otherwise, the voltage on line 154 is determined by the error signal developed by amplifier 150. The input line 148 of error amplifier 150 is limited in magnitude by a zener diode 156 connected between line 148 and a voltage reference or ground potential. A monitoring circuit 157 is connected to monitor lamp current and to provide an output signal on line 159 indicative of lamp current.

Figure 3A:
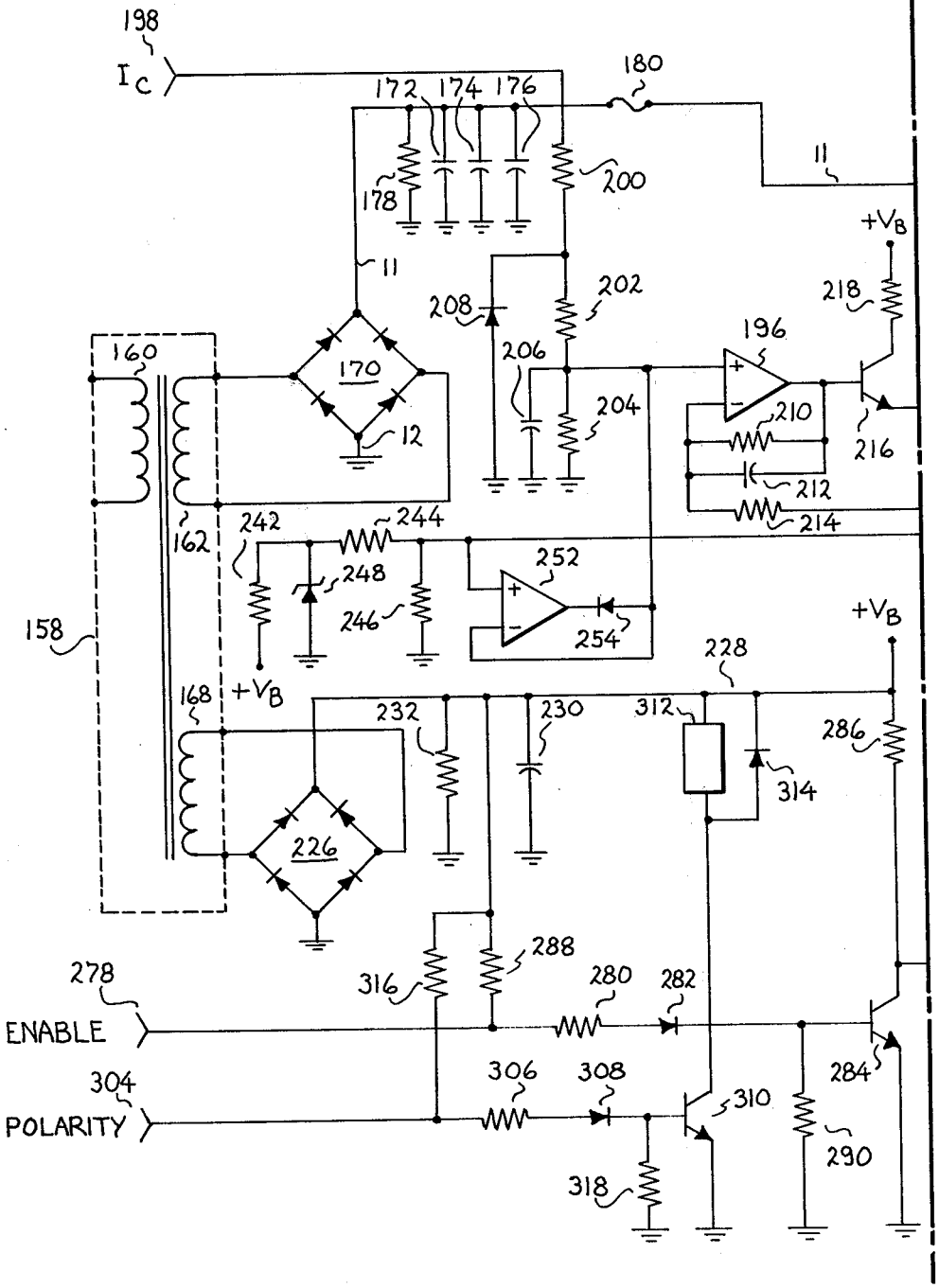
Figure 3B:
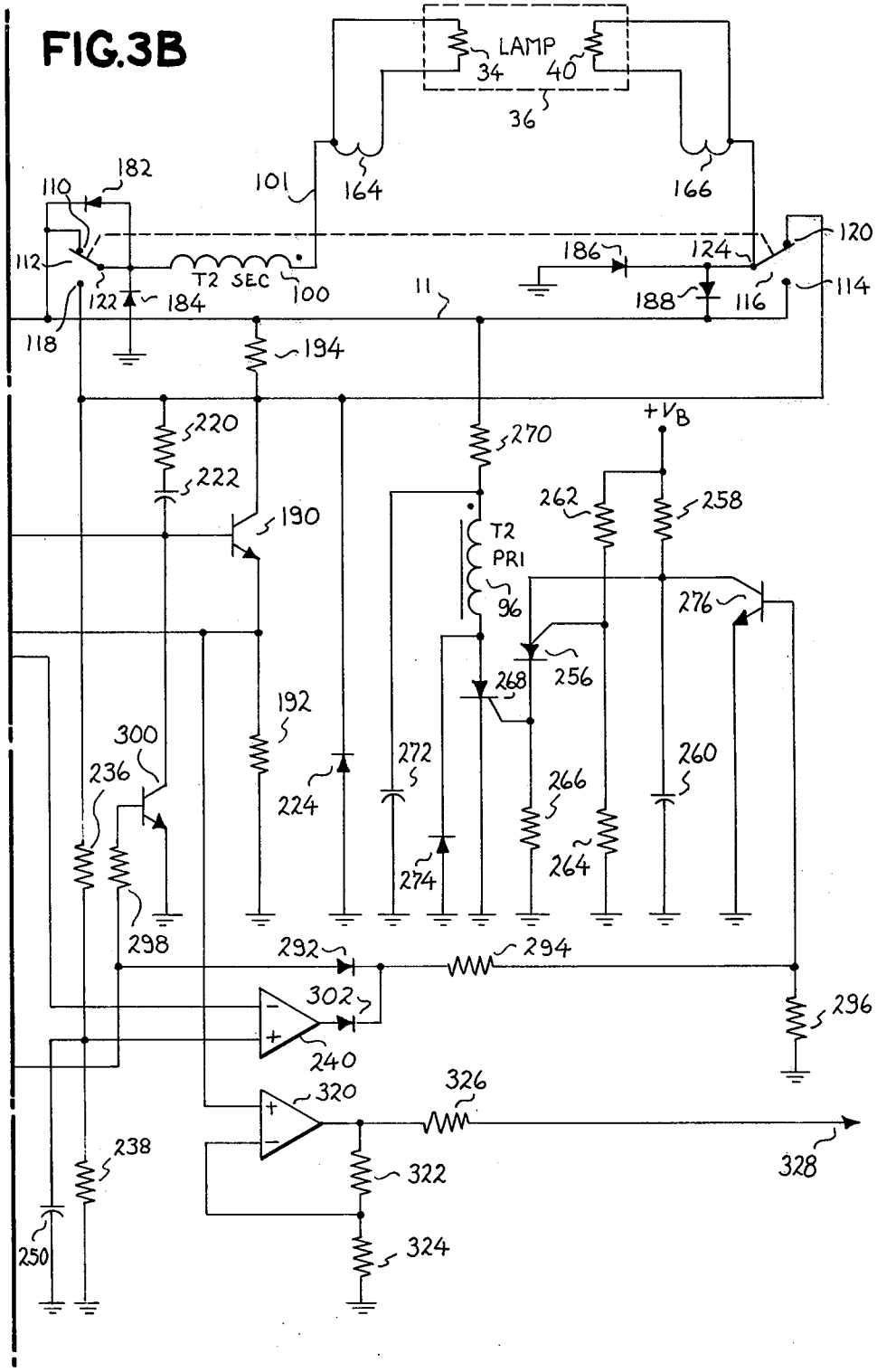

Referring now to FIG. 3, which will be considered to be the combination of FIGS. 3A and 3B joined at the indicated break line, there is shown in more detail a schematic diagram of a circuit arrangement embodying the present invention which not only permits use of low voltage switching relays but also permits lamp voltage reversal while the lamp is lit. The inventive fluorescent lamp ballasting circuit comprises a power transformer 158 having a primary winding 160 adapted to be connected to a source (not shown) of alternating current (AC) power. In the illustrative embodiment, the power, the power transformer 158 includes a first secondary winding 162 for supplying an output voltage of a magnitude sufficient when rectified to maintain the lamp 36 in an energized state. The transformer 158 also includes first and second low voltage output secondary windings 164 and 166 connected respectively to the electrode terminals 34 and 40 of the lamp 36. An additional secondary winding 168 supplies low voltage output power for use in developing reference voltages and for powering the semiconductor devices in the circuit.

The output terminals of the secondary winding 162 are connected to input terminals of a full wave bridge rectifier circuit 170 of a type well known in the art. The output terminals of the rectifier circuit 170 are connected by a line 12 to a ground or reference terminal and via a line 11 to a shunt filter circuit comprising parallel connected capacitors 172, 174 and 176 and parallel connected bleeder resistor 178 all connected between the line 11 and the ground or reference terminal. From the filter circuit, line 11 is connected through a fuse 180 to the terminal 110 of the relay 112. As previously described, the relay 112 works in conjunction with the relay 116 to reverse the polarity of the DC maintenance voltage applied to the lamp 36. In this regard, the contact 110 of relay 112 is also connected to the terminal 114 of relay 116. In addition, the terminal 120 of relay 116 is connected to the terminal 118 of relay 112. The movable contact arm in relay 112 is connected to the terminal 122 and from there to one end of the high voltage secondary winding 100 of the transformer 98. The other end of the secondary winding 100 is connected to the electrode terminal 34 of lamp 36 by a normally noninterruptable connection 101, i.e., under normal conditions the lamp terminal is essentially hardwired to the winding 100 although in practice the connection might include a lamp socket to permit lamp replacement easily or a current shunt for current monitoring.

The electrode terminal 40 of lamp 36 is connected to the terminal 124 which is attached to the movable contact arm of the relay 116. As described previously, the relays 112 and 116 may be two separate relays adapted to switch in synchronism or may, in fact, be separate contacts within a double throw, double pole switch.

A pair of steering diodes 182 and 184 are serially connected between the ground reference terminal and the DC bus 11. The diode 182 and 184 are poled such that current cannot flow from the relatively positive bus 11 to the relatively negative ground reference plance. The junction intermediate the diodes 182 and 184 is connected to the terminal 122. A second pair of steering diodes 186 and 188 are similarly connected in a series arrangement between the ground reference plane and the relatively positive DC bus 11. The junction intermediate the diodes 186 and 188 is connected to the terminal 124 of relay 116. The two pairs of steering diodes serve to clamp each end of the high voltage circuit comprising the high voltage winding 100 and the lamp 36 to a voltage between ground and that voltage appearing on the bus 11.

In order to regulate the current flowing through the lamp 36 after it has been started, the terminals 120 and 118 of relays 116 and 112, respectively, are connected to a current regulating element herein illustrated as an NPN transistor 190. The transistor 190 has its collector terminal connected to the terminal 118 and its emitter terminal connected through a current sensing resistor 192 to the ground return plane. Normal bias current for the collector of transistor 190 is provided via a resistor 194 paralleled by the lamp 36 and transformer secondary winding 100 and connected between the collector of transistor 190 and the DC voltage bus 11.

The transistor 190 is controlled by a constant current regulating circuit comprising an error amplifier 196 which may be, for example, an operational amplifier of a type well known in the art. The input to the operational amplifier 196 is a current command signal $I_C$ applied to a terminal 198 and coupled therefrom through the serially connected resistors 200 and 202 to a first input terminal of the amplifier 196. An additional resistor 204 is connected between the first input terminal of amplifier 196 and ground such that the combination of resistors 200, 202 and 204 form a voltage divider network to reduce the level of voltage supplied to the amplifier 196. In the embodiment described, the voltage divider network was necessary because of the amplitude of the current command signal and in some instances may not be so required. A capacitor 206 connected in parallel circuit arrangement with the resistor 204 aids in establishing the transient response of the current regulator. The diode 208 connected between ground and the junction intermediate resistors 200 and 202 protects the amplifier 196 in the event that the current command signal $I_C$ at terminal 198 is such that the resultant voltage generated at the input terminal of the amplifier 196 attempts to go negative. The gain of the amplifier 196 is established by a feedback resistor 210 in conjunction with an input resistor 214. Resistor 210 is connected between an output terminal and a second input terminal of the amplifier 196. A capacitor 212 connected in parallel circuit arrangement with the resistor 210 functions to stabilize the feedback system of the amplifier. The current feedback signal is applied to the amplifier 196 at its second input terminal through the resistor 214, one end of which resistor is connected to the emitter terminal of the transistor 190. The error signal generated by the amplifier 196 is coupled to a base terminal of a transistor 216 which is connected in an emitter follower mode with the emitter terminal of the transistor 216 being connected to the base terminal of transistor 190. The collector terminal of the transistor 216 is connected to a bias voltage $V_B$ via a collector resistor 218. The resistor 218 is chosen to be of such a value that it allows the transistor 216 to saturate under heavy load thus limiting the maximum current through the transistor 190. The polarities of the voltages developed around the control loop are so arranged that if the lamp current goes below the level set by the input current command signal $I_C$, the feedback voltage from the current sensing resistor 192 compared to the reference voltage will cause the error signal developed by the amplifier 196 to increase thus driving the transistor 216 harder until the lamp current is increased to the proper level as defined by the current command signal $I_C$. A resistor 220 and a capacitor 222 serially connected between the collector and base junction of the transistor 190 serve to provide stability, in part, to the current control loop. Any changes in the input line voltage, the lamp voltage, or changes in the command lamp current will be met by circuit response which will make lamp current equal the commanded lamp current $I_C$. A diode 224 connected between the ground reference terminal and the collector junction of transistor 190 serves to protect the collector of transistor 190 from being pulled below ground in the event of an unexpected transient.

The $V_B$ voltage mentioned previously is a voltage for powering the various semiconductor devices in the circuit of FIG. 3. This voltage is developed at an output terminal of a full wave bridge rectifier 226 which is coupled across the output terminals of the secondary winding 168. Output terminals of the bridge rectifier 226 are connected to ground and to a voltage bus 228 on which the voltage $V_B$ is developed. A filter capacitor 230 is connected between the bus 228 and ground. A bleeder resistor 232 is connected in parallel circuit arrangement with the capacitor 230.

The status of the lamp 36 is determined by sensing the voltage developed at the collector of transistor 190. Sensing is accomplished by using a high impedance average voltage sensing divider circuit comprising resistor 236 and resistor 238 serially connected between the collector junction of transistor 190 and ground. The junction intermediate the resistors 236 and 238 is connected to a noninverting input terminal of an amplifier 240. Amplifier 240 operates as a comparator circuit and uses a fixed reference voltage developed by a voltage divider comprising resistors 242, 244 and 246 serially connected between the voltage supply $V_B$ and ground. A zener diode 248 has one terminal connected to the junction intermediate resistors 242 and 244 and a second terminal connected to ground. The junction intermediate resistors 244 and 246 is connected to the inverting input terminal of the amplifier 240. A capacitor 250 connected in parallel with the resistor 238 provides average filtering of the divided down voltage from the collector of transistor 190 to the input of amplifier 240. The amplifier 240 provides a positive output voltage or logical one signal so long as the average collector voltage is greater than the voltage established by the reference circuit. The collector voltage and comparator amplifier 240 output will be high whenever the lamp circuit is disabled or when the lamp circuit is enabled and the lamp is lit. The output voltage developed by the comparing amplifier 240 will be low only when the lamp circuit has been enabled and the lamp 36 is not lit.

Maximum lamp current is limited by a current limit circuit comprising an amplifier 252. The amplifier 252 has its noninverting input terminal connected to the junction intermediate resistors 244 and 246. The inverting input terminal of amplifier 252 is connected to the reference voltage developed mediate resistors 202 and 204. An output terminal of amplifier 252 is connected through a diode 254 to the junction intermediate the resistors 202 and 204. This latter connection in effect connects the noninverting input terminal of amplifier 196 to the output terminal of amplifier 252. The diode 254 is connected in such a manner that the amplifier 252 is only capable of sinking current. In the event that the command current signal exceeds a predetermined level, the voltage at the inverting input terminal of amplifier 252 begins to exceed the voltage at the noninverting input terminal causing the output voltage to attempt to go negative. This causes the diode 254 to start shunting excess current around resistor 204 thus limiting the voltage presented to the noninverting input terminal 196 of amplifier 252. The result is that the output current will limit at a predetermined value regardless of how high the input current command signal $I_C$ becomes.

The high voltage pulses utilizes to start the lamp 36 are developed by a starting pulse generator comprising a free-running relaxation oscillator which triggers a capacitive discharge stepup circuit through a pulse transformer. The oscillator includes a programmable unijunction transistor 256 having an anode terminal connected through a resistor 258 to a source of bias voltage $V_B$. A discharge timing capacitor 260 is connected from the anode terminal of transistor 256 to ground. The gate electrode of transistor 256 is connected to a junction intermediate a pair of voltage dividing resistors 262 and 264 serially connected between the source $V_B$ and ground. The cathode terminal of transistor 256 is connected through a resistor 266 to ground. The cathode terminal of transistor 256 is also connected to a gate terminal of a silicon controlled rectifier (SCR) 268. The cathode terminal of SCR 268 is connected to ground and its anode terminal is connected to one end of the primary winding 96 of the high voltage pulse transformer. A second end of the primary winding 96 is connected through a resistor 270 to the voltage bus 11. The junction intermediate the resistor 270 and primary winding 96 is connected to ground through a capacitor 272. The junction intermediate primary winding 96 and SCR 268 is connected to ground through a diode 274. The diode 274 is poled so as to conduct reverse current from ground. In order to control the operation of the starting pulse generator circuit and thus to control when a starting pulse is to be applied, the anode terminal of transistor 256 is connected to a controllable switch, herein illustrated as a transistor 276 having its collector terminal connected to the anode terminal of transistor 256 and its emitter terminal connected to ground. When transistor 276 is conducting, the anode terminal of transistor 257 will be tied to ground thus preventing operation of the starting pulse generator. Under normal conditions, transistor 276 is controlled by the ENABLE signal applied to terminal 278. The ENABLE signal is coupled from terminal 278 through a resistor 280 and a diode 282 to a base terminal of a transistor 284. An emitter terminal of transistor 284 is connected to ground and its collector terminal is connected through a collector resistor 286 to the voltage source $V_B$. Base bias current for the transistor 284 is provided by a resistor 288 connected between terminal 278 and the voltage bus 228. An additional biasing resistor 290 is connected between the base terminal of transistor 284 and ground. The collector terminal of the transistor 284 is connected through a diode 292 and a resistor 294 to the base terminal of transistor 276. For biasing and stability, the base terminal of transistor 276 is also connected through a resistor 296 to ground. It will be apparent that an ENABLE signal applied to terminal 278 will cause transistor 284 to conduct thus applying a low or ground reference signal to the base terminal of transistor 276 thereby turning the latter transistor off. With the transistor 276 nonconductive, the capacitor 260 will be allowed to charge towards the $V_B$ voltage and will force the transistor 256 into conduction when the voltage on the capacitor 260 becomes greater than the voltage on the gate terminal of the transistor 256. When transistor 256 becomes conductive, a gate pulse is applied to the gate terminal of SCR 268 thereby gating it into conduction and applying a current pulse through the primary winding 96 of the pulse transformer. This current pulse through winding 96 is converted into a high voltage pulse across the secondary winding 100.

The ENABLE signal also controls the operation of the current regulating transistor 190. In this regard, the collector terminal of transistor 284 is connected through a resistor 298 to a base terminal of a transistor 300. Transistor 300 is connected as a switch and has its emitter terminal connected to ground and its collector terminal connected to the base terminal of transistor 190. Thus, whenever an ENABLE signal is present and the transistor 284 is conducting, a ground reference signal will be applied to the base terminal of transistor 300 thereby maintaining it nonconductive. However, in the absence of an ENABLE signal, the transistor 284 will be nonconductive and a positive voltage signal will be applied to the base terminal of transistor 300 thus turning it on and grounding the base terminal of transistor 190 to thereby interrupt the flow of sustaining current through the lamp 36.

It will be noted that the output signal developed by the comparator 240 is coupled via a diode 302 to the junction intermediate the diode 292 and resistor 294. The diodes 292 and 302 form an OR circuit which operates to disable the starting pulse generator in the absence of an ENABLE signal or whenever the voltage at the collector terminal of transistor 190 is of such a value to indicate that the lamp 36 is lit. Thus, the starting pulse generator will produce high voltage pulses only to start the lamp until such time as the lamp has started.

Reversal of the lamp polarity with the lamp off does not generate any transients which can affect any sensitive parts of the control circuit. The lamp polarity is controlled by a polarity signal applied to a terminal 304 and connected therefrom through a resistor 306 and diode 308 to a base terminal of a transistor switch 310. An emitter terminal of transistor 310 is connected to ground and its collector terminal is connected to an energizing terminal of a relay coil 312. A second energizing terminal of the relay coil 312 is connected to the line 228 for receipt of the $V_B$ voltage. A diode 314 connected in parallel with relay coil 312 provides a reverse current path for inductive currents when the transistor 310 is turned off. Bias current for the transistor 310 is provided via resistor 316 connected between the voltage bus 228 and the terminal 304. An additional bias resistor 318 is connected between the base terminal of transistor 310 and ground. As illustrated, the relay contacts 112 and 116 are part of a double pole, double throw switch controlled by the relay coil 312. A positive polarity signal applied to the terminal 304 will cause the transistor 310 to become conductive and energize the coil 312 to pull the relay contacts 112 and 116 into their energized position. Removal of the positive polarity signal will cause transistor 310 to be turned off thereby deenergizing the coil 312 and allowing the contacts 112 and 116 to revert back to their normally deenergized position.

The protection circuit for the polarity reversing relay contacts 112 and 116 permits the use of a low cost general purpose relay for polarity reversal even though polarity reversal may occur during time periods when the lamp 36 is lit. Assuming for purposes of illustration that the circuit has been in operation and that lamp current is flowing through the secondary winding 100, the secondary inductance of transformer winding 100 has stored energy which will cause current to continue to flow until the energy is removed. When a polarity reversal signal is received, the relay contacts 112 and 116 will break the main current path as they swing toward their new position. When the contacts 112 and 116 break the main current path, each end of the circuit comprising the secondary winding 100 and lamp 36 is placed at an uncommitted potential with secondary current still flowing through the winding 100. The voltage developed at the end of secondary winding 100 attached to terminal 122 is clamped between the voltage on bus 11 and ground by virtue of the diodes 182 and 184. Similarly, the voltage at the end of the lamp which is attached to terminal 124 is clamped between the voltage on bus 11 and ground by virtue of the diodes 186 and 188. In the illustrated embodiment, with a conventional current path flowing from the bus 11 through the contacts 110 and 122 and left to right through the lamp and secondary winding 100, a voltage potential that is positive at the dotted end of the winding 100 is created. Accordingly, a current path is formed through the diode 184, secondary winding 100, lamp 36 and the diode 188 to the positive bus". In the event that the initial lamp current had been flowing in the opposite direction through the winding 100, the current path would then be formed through the diode 186, the lamp 36, the winding 100 and the diode 182 to the bus". Because both the terminals 122 and 124 are clamped to a voltage between ground and the voltage on the DC bus 11, both the relay contact 112 and relay contact 116 never experience a voltage transient in excess the DC bus voltage. Accordingly, both of the relay contacts may be general purpose, low voltage relays.

The illustrated lamp starting and current controlled circuit, i.e., the electronic ballast circuit, also includes a current test point which permits or provides an output voltage that indicates lamp current when the lamp is lit. The output voltage is developed by an amplifier 320 connected in an operational amplifier mode. The amplifier 320 includes a feedback resistor 322 connected between an output terminal and an inverting input terminal. The inverting input terminal also includes a bias resistor 324 connecting the input terminal to ground. The noninverting input terminal of amplifier 320 is connected to receive the current signal developed at the emitter terminal of transistor 190 across the current sensing resistor 192. The output terminal of amplifier 320 is connected through a resistor 326 to the current test point 328.

In the general operation of the circuit of FIG. 3, when an AC voltage is applied to the primary winding 116 of the transformer 158, the secondary winding 162 and 168 each provide through respective rectifier circuits 170 and 226 the DC voltages for operation of the control circuit. Thereafter, an ENABLE, signal applied through terminal 278 gates on the transistor 284 thus turning off the transistor 276 and allowing the start pulse generator to begin operation. Once the lamp has been lit by operation of the start pulse generator, the amplifier 240 senses that the voltage at the collector of transistor 190 is of such a magnitude to indicate that the lamp 36 is lit and provides a signal to gate transistor 276 into conduction thereby terminating operation of the start pulse generator. Each time that it is desired to reverse the polarity of the voltage applied to the lamp 36, a signal is applied to the terminal 304 to energize or deenergize the relay coil 312 by virtue of controlling the conduction of transistor 310. The diodes 182 and 184 and the diodes 186 and 188 protect the relay contacts from seeing transient high voltages and provide current paths for lamp current during the time when the relays are being switched.

The disclosed invention provides a significant reduction in the complexity of circuitry required for control of a fluorescent lamp, particularly in a circuit which incorporates DC lamp operation with polarity switching while the lamp is lit. This circuit permits the use of low cost general purpose relays to effect polarity reversal and limits the voltage applied to those relays in order to avoid problems of sticking contacts inherent with high current switching relays.

Although the principles of the invention have now been made clear in an illustrative embodiment, it will be apparent to those skilled in the art that many modifications, constructions and arrangements useful in the practice of the invention which are particularly adapted for specific environments and operating requirements may be made without departing from those principles. The appended claims are therefore intended to cover and embrace any such modifications, subject only to the limit and true spirit and scope of the invention.

What I claim is:

1. An electronic ballast circuit for controlling illumination from a gaseous discharge lamp having first and second electrode terminals, comprising:

(a) a source of relatively high voltage power having first and second power output terminals;

(b) normally noninterruptable means connecting said first terminal of said high voltage power source to the first terminal of the lamp;

(c) a d.c. source of relatively low voltage power having first and second power output terminals;

(d) first switching means arranged for selectively connecting the second terminal of the lamp to said first or to second terminal of said DC source;

(e) second switching means arranged for selectively connecting said second terminal of said high voltage power source to said second or to said first terminal of said DC source; and, (f) means for controlling said first and said second switching means whereby the series combination of the lamp and said high voltage power source are selectively connected in forward or reverse polarity across said DC source.

2. The ballast circuit of claim 1 and including:

(a) a first unidirectional conducting means connected between said second terminal of the lamp and said first terminal of said DC source; and , (b) a second unidirectional conducting means connected between said second terminal of said high voltage power source and said first terminal of said DC source, said first and said second conducting means providing a current path for inductive circulating current when said DC source is turned off.

3. The ballast circuit of claim 2 and including:

(a) third unidirectional conducting means connected between said second terminal of said DC source and said second terminal of said high voltage power source; and, (b) fourth unidirectional conducting means connected between said second terminal of the lamp and said second terminal of said DC source, whereby said first, second, third and fourth unidirectional conducting means form a full wave rectifying bridge circuit coupling the series combination of the lamp and said high voltage power source across said first and second terminals of said DC source to thereby limit the voltage appearing on said first and said second switching means to a magnitude substantially equal to said DC source voltage.

4. The ballast circuit of claim 3 wherein said DC source includes:

(a) a current regulating transistor having collector, base and emitter terminals, said collector terminal being connected to each of said first and second switching means, said emitter terminal being connected to said second terminal of said DC source and said base terminal being connected for receiving a current control signal, said transistor being thereby connected in a series electrical circuit between said lamp and said DC source; and, (b) unidirectional conducting means connected in a shunt path with said transistor whereby said transistor is protected from reverse current transients.

5. An electronic ballast circuit for a gaseous discharge lamp comprising:

(a) a power transformer having a primary winding adapted for connection to a source of AC power and a secondary winding for producing AC voltage of a desired magnitude;

(b) rectifying means connected to said secondary winding for converting said AC voltage to a DC voltage;

(c) filter means connected to said rectifying means for smoothing said DC voltage, said filter means including at least a first capacitor connected between relatively positive and relatively negative DC voltage output terminals;

(d) first controllable switching means having at least first, second and third contact terminals, said first switching means having a first state for interconnecting said first and second contact terminals and a second state for interconnecting said first and third contact terminals;

(e) second controllable switching means having at least first, second and third contact terminals, said second switching means having a first state for interconnecting said first and second contact terminals and a second state for interconnecting said first and third contact terminals;

(f) a gateable high voltage pulse source for developing a relatively high voltage pulse between first and second output terminals;

(g) means for connecting one of said DC voltage output terminals to said second terminal of each of said first and second switching means;

(h) means for connecting said first terminal of said first switching means to said first terminal of said pulse source;

(i) means for connecting said second terminal of said pulse source to one terminal of said lamp;

(j) means for connecting another terminal of said lamp to said first terminal of said second switching means;

(k) means for regulating the magnitude of current through said lamp, said current regulating means being serially connected between the other of said DC voltage output terminals and said third terminal of each of said first and second switching means; and, (l) means connected in circuit with said lamp and said pulse source for limiting the voltage appearing at each of said first and second switching means to a value substantially equal to the magnitude of said DC voltage.

6. The ballast circuit of claim 5 wherein said voltage limiting means comprises:

(a) a first diode connected between said first terminal and said second terminal of said first switching means, said diode being poled in a direction to normally block the flow of current from said rectifying means;

(b) a second diode connected between said first terminal and said third terminal of said first switching means, said second diode being poled in a direction to normally block the flow of current from said rectifying means;

(c) a third diode connected between said first terminal and said second terminal of said second switching means, said third diode being poled in a direction to normally block the flow of current from said rectifying means; and, (d) a fourth diode connected between said first terminal and second third terminal of said second switching means, said fourth diode being poled in a direction to normally block the flow of current from said rectifying means.

7. The ballast circuit of claim 6 wherein said current regulating means comprises:

(a) a transistor serially connected between said third terminal of each of said first and second switching means and said other terminal of said DC voltage output terminals;

(b) current measuring means connected in circuit with said transistor for providing a signal representative of lamp current;

(c) means for providing a signal representative of a desired magnitude of lamp current;

(d) means responsive to said lamp current representative signal and to said desired lamp current signal for controlling the conductivity of said transistor in a manner to adjust lamp current to said desired magnitude.

8. The ballast circuit of claim 7 and including a diode connected in a reverse current path in parallel with said transistor.

9. The ballast circuit of claim 8 and including a current limiting circuit connected to said lamp current responsive means for limiting the maximum magnitude of lamp current.

10. The ballast circuit of claim 8 and including a lamp status indicating circuit connected for sensing the voltage at the collector of said transistor, said indicator circuit providing an output signal of a first polarity when said lamp circuit is enabled and said lamp is not lit and providing an output signal of a second polarity when said lamp circuit is disabled or when said lamp circuit is enabled and said lamp is lit.

11. The ballast circuit of claim 5 wherein said high voltage pulse source comprises:

(a) a pulse transformer having a primary winding and a secondary winding, said secondary winding being connected in a current path between said first and second output terminals of said pulse source;

(b) a free-running transistor oscillator circuit for providing time spaced discharged pulses;

(c) a capacitor discharge circuit including a capacitor, said pulse transformer primary winding, normally nonconductive switch apparatus and means for charging said capacitor; and, (d) means for coupling said discharge pulses to said switch apparatus for periodically causing said switch apparatus for conduct whereby said capacitor discharges through said primary winding for generating a relatively high voltage pulse between said output terminals of said secondary winding.

12. The ballast circuit of claim 11 and including means for inhibiting operation of said free-running oscillator when said lamp is lit.

* * * * *